US009771698B2

(12) United States Patent
Khan

(10) Patent No.: US 9,771,698 B2
(45) Date of Patent: Sep. 26, 2017

(54) DIRECTIONAL SHOVEL

(71) Applicant: Sitara R Khan, Old Westbury, NY (US)

(72) Inventor: Sitara R Khan, Old Westbury, NY (US)

( * ) Notice: Subject to any disclaimer, the term of this patent is extended or adjusted under 35 U.S.C. 154(b) by 210 days.

(21) Appl. No.: 14/669,306

(22) Filed: Mar. 26, 2015

(65) Prior Publication Data

US 2015/0308059 A1 Oct. 29, 2015

Related U.S. Application Data

(60) Provisional application No. 61/970,422, filed on Mar. 26, 2014.

(51) Int. Cl.

| | |
|---|---|
| ***E01H 5/02*** | (2006.01) |
| ***E01H 5/06*** | (2006.01) |
| ***E02F 3/02*** | (2006.01) |
| ***E01H 5/04*** | (2006.01) |

(52) U.S. Cl.

CPC ..... *E01H 5/061* (2013.01); *E01H 5/02* (2013.01); *E01H 5/045* (2013.01); *E02F 3/02* (2013.01)

(58) Field of Classification Search

CPC ..... E01H 5/02; E01H 5/061; E01H 5/045; E01H 5/065; E02F 3/02; A01B 1/222

USPC ..... 294/50.9, 51, 53.5, 54.5; 37/265, 270, 37/282–285

See application file for complete search history.

(56) References Cited

U.S. PATENT DOCUMENTS

| | | | | |
|---|---|---|---|---|
| 328,633 | A | 10/1885 | Angell | |
| 813,983 | A | 2/1906 | Luney | |
| 830,871 | A | 9/1906 | Wilken | |
| 1,375,505 | A | 4/1921 | Grady | |
| 1,415,979 | A * | 5/1922 | Bedford | E01H 5/02 172/358 |
| 1,514,076 | A | 11/1924 | Brown | |
| 1,524,639 | A | 1/1925 | Grady | |
| 1,572,824 | A | 2/1926 | Tatge | |
| 1,656,613 | A * | 1/1928 | Walter | E01H 5/065 37/270 |
| 1,667,591 | A | 4/1928 | Eden | |
| 1,847,133 | A | 3/1932 | Nieman | |
| 1,867,255 | A * | 7/1932 | De La Mater | E01H 5/065 37/282 |
| 1,882,945 | A | 10/1932 | Ross | |
| 2,342,436 | A * | 2/1944 | Stuart | F24B 15/06 294/177 |
| 2,388,985 | A | 11/1945 | Martin | |

(Continued)

*Primary Examiner* — Dean Kramer

(74) *Attorney, Agent, or Firm* — Thomas A. O'Rourke; Bodner & O'Rourke, LLP

(57) ABSTRACT

The present invention relates to a hand or motorized push shovel/plow with directional left or right side disbursement of snow, granular material, thicker liquids and other such desired materials with ease and comfort. The shovel allows a user to direct a shoveled load to a first or a second side of the shovel while moving the shovel in a substantially straight direction and generally comprises a handle, a shaft extending from the handle to a base shovel blade, and a steering mechanism secured along a portion of the shaft or handle and in steering communication with a directional shovel blade that is in a relational arrangement on top of the base shovel blade. The steering mechanism allows a user to angle the directional blade in a left or right direction.

7 Claims, 10 Drawing Sheets

(56) References Cited

U.S. PATENT DOCUMENTS

| | | | | |
|---|---|---|---|---|
| 2,432,780 | A | | 12/1947 | Mader |
| 2,441,449 | A | | 5/1948 | Shaw |
| 2,460,560 | A | | 2/1949 | Williams |
| 2,463,150 | A | | 3/1949 | Camp |
| 2,470,217 | A | | 5/1949 | McLoughlin |
| 2,513,230 | A | | 6/1950 | Bourne |
| 2,520,606 | A | | 8/1950 | McLoughlin |
| 2,590,143 | A | | 3/1952 | Adams |
| 2,629,624 | A | | 2/1953 | Nelles |
| 2,653,397 | A | | 9/1953 | Butler |
| 2,715,786 | A | | 8/1955 | Dorko |
| 2,720,043 | A | | 10/1955 | Chamberlin |
| 2,772,490 | A | | 12/1956 | Hnastchenko |
| 2,803,071 | A | | 8/1957 | Pochopien |
| 2,811,792 | A | | 11/1957 | Cork |
| 2,846,785 | A | | 8/1958 | Underwood |
| 2,852,872 | A | | 9/1958 | Benz |
| 2,852,873 | A | | 9/1958 | Benz |
| 2,863,232 | A | | 12/1958 | Steinbach |
| 2,896,993 | A | | 7/1959 | Pollock |
| 2,900,744 | A | | 8/1959 | Champain |
| 2,919,153 | A | | 12/1959 | Benton |
| 2,930,152 | A | | 3/1960 | Pipken |
| 2,967,363 | A | | 1/1961 | Meier |
| D190,820 | S | | 7/1961 | O'Connor |
| 3,107,446 | A | | 10/1963 | Messinger |
| 3,343,807 | A | | 9/1967 | Moraski |
| 3,469,326 | A | | 9/1969 | Malickson |
| 3,475,838 | A | | 11/1969 | Hagen |
| 3,526,979 | A | | 9/1970 | Ladewski |
| 3,583,747 | A | | 6/1971 | Lambert |
| 3,594,932 | A | | 7/1971 | Eriksson |
| 3,643,356 | A | | 2/1972 | Gohl |
| 3,748,761 | A | | 7/1973 | Chetwynde |
| 3,751,058 | A | | 8/1973 | Larsen |
| 4,153,287 | A | | 5/1979 | Towsend |
| 4,161,073 | A | | 7/1979 | Oakes |
| 4,179,828 | A | | 12/1979 | Brunty |
| 4,214,385 | A | | 7/1980 | Baranowski |
| 4,224,751 | A | | 9/1980 | Schoemann |
| 4,245,411 | A | | 1/1981 | McMath |
| 4,264,095 | A | | 4/1981 | Lemasters |
| 4,302,894 | A | | 12/1981 | Emma |
| 4,597,204 | A | | 7/1986 | Heiden |
| 4,757,622 | A | | 7/1988 | Morris |
| 4,858,348 | A | | 8/1989 | Lundy |
| 4,910,893 | A | | 3/1990 | Asay |
| 5,018,282 | A | | 5/1991 | Hong |
| 5,048,206 | A | | 9/1991 | Jones |
| 5,074,064 | A | | 12/1991 | Nickels |
| 5,123,187 | A | | 6/1992 | Zamaria |
| 5,271,169 | A | * | 12/1993 | Konsztowicz ..... E01H 5/02 37/270 |
| 5,431,468 | A | | 7/1995 | Rosenshine |
| 5,511,327 | A | | 4/1996 | Jurkowski |
| 5,511,328 | A | | 4/1996 | Fingerere |
| D375,235 | S | | 11/1996 | Spear |
| 5,581,915 | A | | 12/1996 | Lobato |
| 5,782,518 | A | | 7/1998 | Scruggs |
| 5,829,808 | A | | 11/1998 | Colla |
| 5,918,921 | A | | 7/1999 | Samuelson |
| 6,053,548 | A | | 4/2000 | Bowles |
| 6,163,986 | A | | 12/2000 | Townsend |
| 6,334,640 | B1 | | 1/2002 | Werner |
| D459,641 | S | | 7/2002 | Guneysu |
| 6,439,629 | B1 | * | 8/2002 | Bieth ..... E21B 7/265 294/50.9 |
| 6,457,757 | B2 | | 10/2002 | Hendrick |
| 6,474,007 | B1 | | 11/2002 | Sueshige |
| 6,523,839 | B2 | | 2/2003 | Simmons |
| 6,578,890 | B1 | * | 6/2003 | Gilmore ..... E04D 13/106 294/53.5 |
| 6,675,507 | B2 | | 1/2004 | Petruzzelli |
| 6,735,887 | B1 | | 5/2004 | Muzzammel |
| 6,922,920 | B1 | | 8/2005 | Stratz |
| 6,948,268 | B1 | | 9/2005 | Ronca |
| D523,710 | S | | 6/2006 | Noonan |
| 7,111,418 | B2 | | 9/2006 | Noonan |
| 7,305,779 | B1 | | 12/2007 | Purvis |
| 7,380,848 | B2 | | 6/2008 | Petruzelli |
| 7,681,932 | B2 | * | 3/2010 | Chang ..... E01H 5/02 294/54.5 |
| 7,681,933 | B2 | | 3/2010 | Chesness |
| 8,001,707 | B2 | | 8/2011 | Coles |
| 2001/0045029 | A1 | | 11/2001 | Fulton |
| 2005/0160632 | A1 | | 7/2005 | Williams |
| 2006/0249964 | A1 | | 11/2006 | Brazeau |
| 2007/0013198 | A1 | | 1/2007 | Brazeau |
| 2007/0227048 | A1 | | 10/2007 | Adinata |

* cited by examiner

DIRECTIONAL SHOVEL

CROSS REFERENCE TO RELATED APPLICATIONS

This application claims priority on U.S. Provisional Application Ser. No. 61/970,422 filed on Mar. 26, 2014, the disclosures of which are incorporated herein by reference.

FIELD OF THE INVENTION

The present invention relates to a shovel that includes a means for directing a shoveled load to a left or right side of the shovel relative to the direction in which the shovel is traveling. In particular, the shovel includes a base blade and a directional blade in a relational arrangement on top of the base blade to direct a shoveled load.

BACKGROUND OF THE INVENTION

Many different designs for shovels have been developed over the years. Most existing shovels are comprised of a blade or scoop, either straight or curved, with an edge on the bottom of the blade to help load the material onto the shovel blade. A shaft is connected to the top of shovel blade and may also be connected to a handle at its free end. A shovel is designed to move various volumes and weights of materials, such as dirt, gravel, snow, slush, or other debris. However, the amount of material that a shovel may displace is limited by the surface area of the blade or scoop and height of the load on the blade.

A shovel is generally used by applying a moving force to the handle of the shovel which is connected to a shaft that is connected to the shovel blade at an angle. The shovel is then moved underneath the material to hold a desired load and then the load is displaced by the user applying an upwards lifting force to lift the shovel blade. Such an upward force may be damaging to a user's joints and muscles and can result in minor or grave and serious injuries. Accordingly, the present invention is related to a shovel that reduces the stress placed on a person's muscles, joints, back, spine, and heart while shoveling by disclosing a shovel with a directional blade that does not require a user to lift the shovel blade to displace a shoveled load.

OBJECTS OF THE INVENTION

It is an object of the invention to provide a directional shovel that is easy and convenient to use.

It is another object of the invention to provide a shovel that allows a user to easily direct snow or another load without having to lift the shovel to displace the shoveled load.

It is a further object of the invention to provide a direction shovel that allows a user to push the shovel along a straight path yet direct a shoveled load to either side of the shovel.

SUMMARY OF THE INVENTION

The present invention relates to a hand or motorized push shovel/plow with directional left or right side disbursement of snow, granular material, thicker liquids and other such desired materials with ease and comfort. The shovel allows a user to direct a shoveled load to a first or a second side of the shovel while moving the shovel in a substantially straight direction and generally comprises a handle, a shaft extending from the handle to a base shovel blade, a steering mechanism secured along a portion of the shaft or handle and in steering communication with a directional shovel blade that is in a relational arrangement on top of the base shovel blade. The steering plate allows a user to angle the directional blade in a left or right direction. The steering mechanism also allows a user to keep the directional blade in a substantially straight direction. The shovel may further include wheels to reduce the force required to push the shovel. The wheels are preferably of a light weight but sturdy material such as firm plastic, resin, aluminum or other such material or composite of materials that would enable ease of pushing, but not unduly interfere with lifting the shovel to empty it if necessary.

The purpose of the present invention is to allow a user to push the shovel along a straight path, but yet have the snow moved to the right or the left side of the shovel by positioning the directional blade in a left or right direction. In operation, a user will walk from the middle of the path and displace snow or another desired load to the left or right of the shovel without needing to lift the plow or shovel.

The handle may have a tubular profile and be of a T-Bar or a U-Bar configuration in the middle of which could be the steering mechanism that may be a lever or a turn crank that is connected via a cable, rods or other mechanisms to the top section of the directional shovel blade. There may also be a frame that may support the wheels, the handle(s), and/or the one, two, or more sets of base shovel blade adjustment mechanisms and shaft/handle adjustment mechanisms.

The shaft/handle adjustment mechanism allows the shaft/handle configuration to be adjusted in height and angle of attachment to the wheels to account for the height and/or comfort of the operator. The base shovel blade adjustment mechanism allows the actual plow angle to the ground be adjusted, to allow for sharper cutting angles while plowing higher or lower levels of snow or other loads. The adjustment mechanisms may employ either screws and turning knobs or levers in combination with grooves or cavities or otherwise to maintain the adjusted positions.

Wheels may be present in embodiments of the present invention that use either T-bar, U-bar or a combination U-bar and T-bar configuration. Further, the wheels may be secured by washers and indentations to keep the wheels from moving medially or laterally. In the U-bar configuration, the U-bar may be connected to the middle rod running between the two wheels with a pipe running over the rod. It is to be noted that this pipe is preferably placed before the wheels are secured in and connected to the pipe. The U-bar may be permanently welded or connected with this pipe on its lateral sides closest to the wheels.

In the embodiment where the T-Bar is connected to a mini short U-bar, the T-bar is connected to the U-bar close to the wheels and the middle of the T-bar may be connected to the T-bar handle not only to the side near the wheels but also to the middle to the pipe rolling over the rod, thereby connecting the wheels. Further, the U-bar may also have a T-connection wherein a third support is used where the adjustments of the direction of the blade can be controlled. The tube connecting to the T-bar may have on its sides the capability of being adjusted by a flat plate to adjust the level, height and the angle of the arms to the plow. At the wheels and the frame of the rear assembly a plate may be used and is more curved over the wheels. The plate may raise the angle of the plow that is relative to the level of the surface being shoveled by raising the back of the blade (the point furthest from the ground) from facing back toward the operator to the facing the top towards the sky. This adjustment configuration may allow more comfortable operation of the shovel for shoveling loads ranging from light to heavy.

DETAILED DESCRIPTION OF THE INVENTION

Figure 1A:
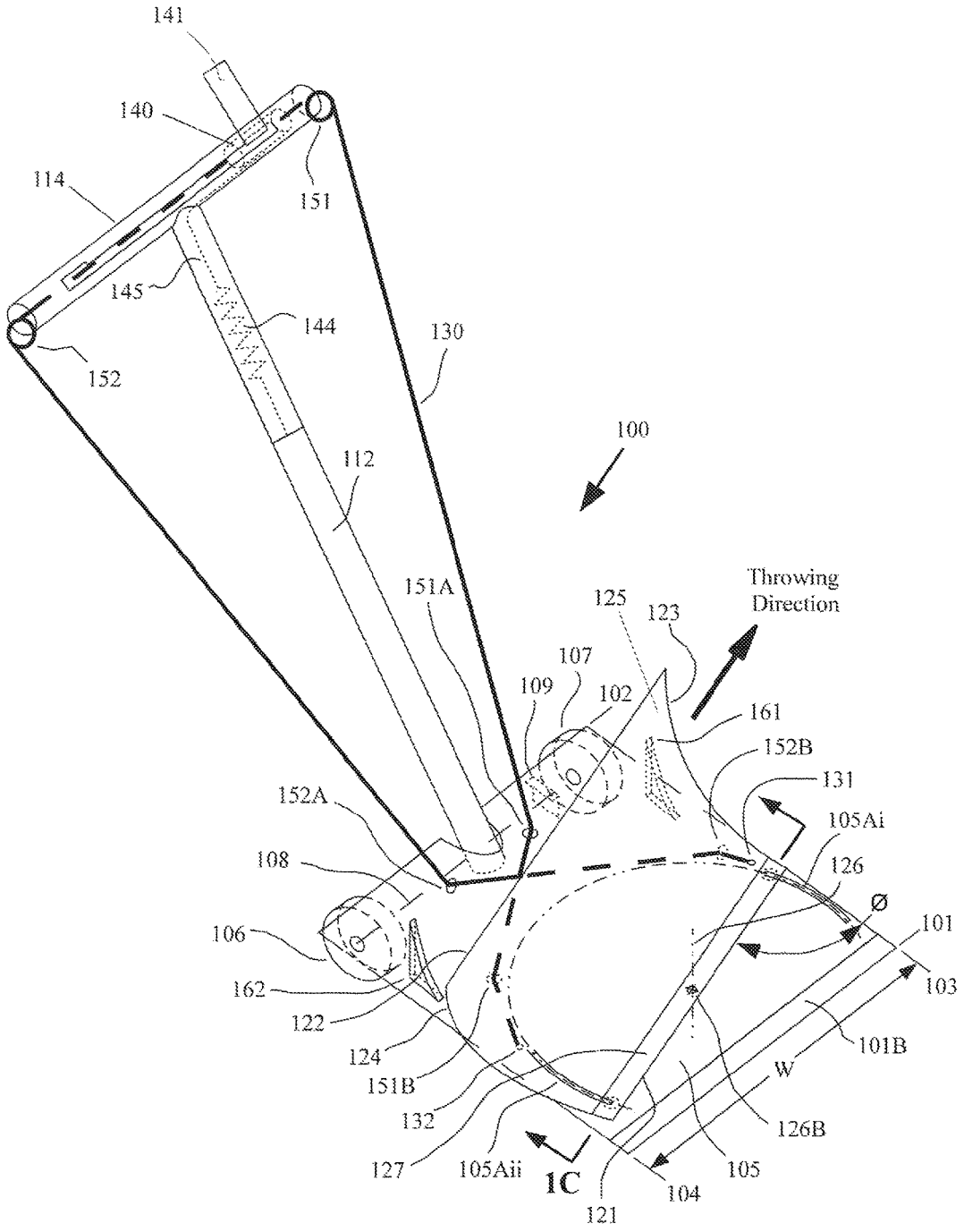
FIG. 1A shows a left front perspective view of a first embodiment of the directional shovel of the present invention.

FIG. 1A shows a first embodiment of the directional shovel 100 of the present invention. The directional shovel 100 may include a base shovel blade 105 that extends from a leading edge 101 to a trailing edge 102, and from a first side 103 to a second side 104. It may be preferable to construct at least a portion of the base shovel blade as a generally flat member, as discussed hereinafter. However, the base shovel blade 105 may also be formed into a modestly curved member.

The leading edge 101 of the base shovel blade 105 may have a bevel 101B formed on the upper surface. During use of the directional shovel 100, the base shovel blade 105 may normally be disposed to be at an angle with respect to the ground, as the leading edge 101 may be in contact with the ground, while the trailing edge 102 may be elevated above the ground by a one or more wheels attached thereto. Although one wheel may be used to elevate the trailing edge 102, additional stability may be provided through the use of a first wheel 106 and a second wheel 107. The first and second wheels 106 and 107 may be rotatably coupled to the base shovel blade 105 using any suitable means, including, but not limited to, the use of one or more axles that may extend from or be joined to the base shovel blade.

In FIG. 1A, an axle 108 may be supported relative to the bottom of the base shovel blade 105 using one or more angle brackets 109. Alternatively, the axle 108 may be fixedly secured directly to the base shovel blade, and openings may be formed in the trailing edge of the base shovel blade to provide clearance for the wheels. Thus, the wheels may be rotatably mounted so as to be at a distance apart being less that the width W of the base shovel blade 105 (i.e., less than the distance between side 103 and side 104), as seen in FIG. 1A. This may permit the wheels to operate upon the ground surface only after scooping or pushing has been accomplished by the device, which may be advantageous, as discussed hereinafter. Alternatively, the wheels 106 and 107 may be rotatably mounted so as to be positioned laterally apart from each other at a distance greater than the width W of the base shovel blade 105.

A shaft 112 may extend upwardly and at an angle with respect to the base shovel blade 105, and may be fixedly secured thereto, using any suitable means, including, but not limited to, welding of the joint, adhesive, mechanical fasteners, etc., or any combination thereof. Gusset plates may also be used to reduce the load concentration at that connection. In addition, the shaft 112 may extend below the bottom surface of the base shovel blade 105 and may provide additional support for the axle 108. A handle 114 may be fixedly secured to the upper end of the shaft 112, which may permit the user of the directional shovel 100 to propel the device in a forward direction.

A directional (upper) shovel blade 125 may be pivotally coupled to the base shovel blade 105, and may be configured to pivot about axis 126 between at least two pivotal positions. The pivot coupling may be a simple riveted connection or other bolt/nut type of combination. Alternatively, as seen in the cross-sectional view of FIG. 1C, the pivotal coupling may utilize a miniature bearing 126B to reduce friction and improve the pivotal movement between the base shovel blade 105 and the directional shovel blade 125. The miniature bearing 126E may be available from Bearings Limited, in Hauppauge, N.Y.

Figure 1B:
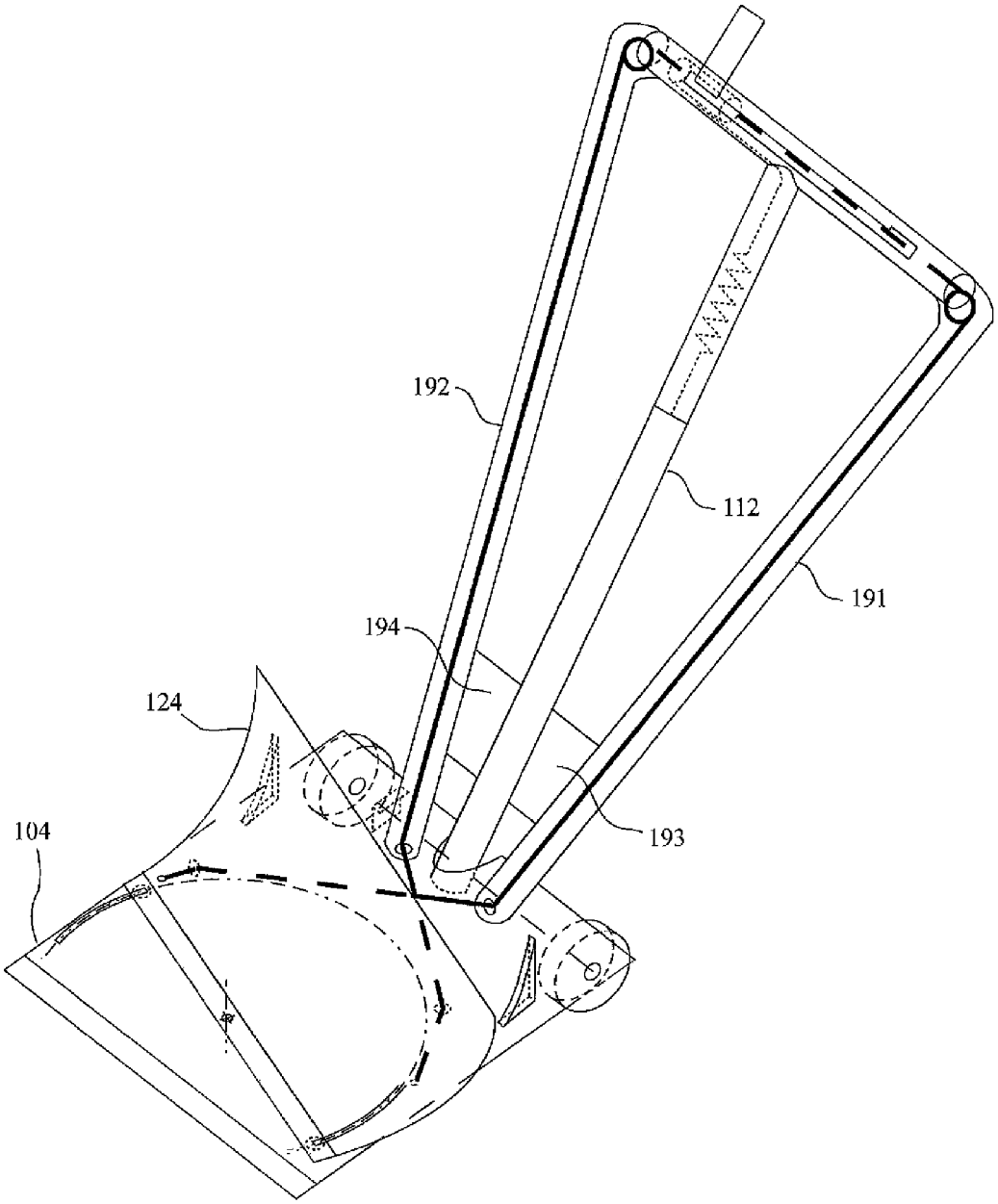
FIG. 1B shows a right front perspective view of the embodiment of FIG. 1A, with the directional shovel blade shifted to the opposite side, but with the cable also enclosed in tubing.
Figure 1E:
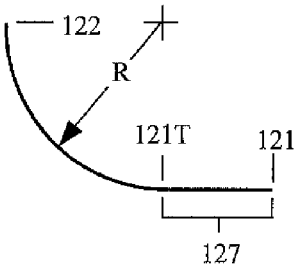
FIG. 1E shows a cross-sectional view of the directional shovel blade of FIG. 1D.

To further improve the pivotal movement between the base shovel blade 105 and the directional shovel blade 125, a portion 127 of the directional shovel blade beginning its forward edge 121 may be substantially flat, which may be pivotally coupled to a substantially flat portion of the base shovel blade. The shape of the directional shovel blade 125 may be better understood from the views of the blade shown in FIGS. 1D and 1E. As seen in FIG. 1E, the directional shovel blade 125 may be formed of a portion of a cylinder having a radius R. (Note that a cross-sectional shape other than an arc, i.e., other than blade formed of a part-cylinder, may also be used). The flat portion 127 may extend tangentially away from the cylindrical portion. Therefore, the cylindrical portion of the directional shovel blade 125 may extend, in the profile view of FIG. 1E, from the theoretical tangency at 121T to its upper rear end at 122.

Figure 1D:
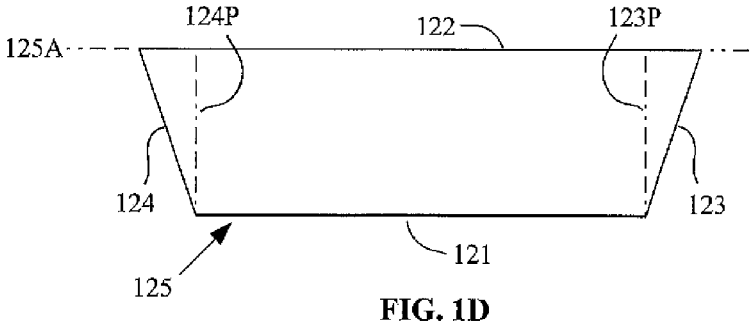
FIG. 1D is a front view of the directional shovel blade of the directional shovel of FIG. 1A.

As seen in the front view of the directional shovel blade 125 in FIG. 1D, its cylindrical portion may terminate at two lateral ends, 123P and 124P, which may be perpendicular to the axis 125A of the cylinder. However, this would not produce an end for the directional blade—i.e., end 123P—that would be that would be coplanar with the side 103 of the base blade 105, when the directional blade is at the pivotal position shown in FIG. 1A, which is desirable. Without this coplanar relationship, all of the material (snow, etc.) that is driven up the directional blade may not be thrown in the lateral throwing direction illustrated in FIG. 1A, and some may instead fall back onto the top of the base blade 105 above the wheels. To produce the desired coplanar edges—i.e., 123 for the directional blade 125, and 103 of the base blade 105, which are shown in FIG. 1A—the blade 125 shown in FIG. 1D should not have an end 123P that is formed perpendicular to axis 125A, and instead an end 123 should be formed at an angle thereto. The end 123 would therefore be elliptically shaped, and the angle that it would need to be formed at relative to the axis 125A of the cylinder, is the same as the angular relationship of the axis 125A relative the vertical plane formed by the side 103 of the base blade 105 (FIG. 1A). Note that the front edge 121 of the directional blade 125 may be formed to be parallel to the axis 125A, and in that instance, the angular relationship may also be illustrated by the angle θ shown in FIG. 1A. Similarly, to produce the coplanar end 124 of the directional blade 125 with the end 104 of the base blade 105, which are shown aligned in FIG. 1B, the blade 125 shown in FIG. 1D should not have an end 124P be formed perpendicular to axis 125A, and instead it should have an end 124 be formed at an angle thereto.

Therefore, two desirable pivotal positions of the directional shovel blade 125 are shown in the figures, with a first pivotal position shown in FIG. 1A, in which end 123 of the directional blade is aligned with and substantially co-planar with the end 103 of the base blade 105. A second desired pivotal position is shown in FIG. 1B, in which end 124 of the directional blade 125 is aligned with and substantially co-planar with the end 104 of the base blade 105.

Several different means of controlling movement of the directional blade 125 between those two pivotal positions may be used. In one embodiment, a cable 130 may be used to control the pivotal positioning. As seen in FIG. 1A, a sliding member 140 may be slidably mounted to, or within, the handle 114. A first end 131 of cable 130 may be fixedly secured to a lower portion of the directional shovel blade 125, proximate to end 123, while a second end 132 of cable 130 may be secured to a lower portion of the directional blade 125, proximate to end 124. A central portion of the cable 130 may be secured to the sliding member 140. (Note that two cables may alternatively be used). The sliding member 140 may be configured to slide between a first position with respect to the handle 114, and a second position. Movement of the sliding member 140 in a first direction (i.e., towards the user's left hand) may thus cause tension in the right side of the cable 130 to cause the directional shovel blade 125 to pivot about axis 126 to be in the pivotal position shown in FIG. 1A. Movement of the sliding member 140 in a second direction (i.e., towards the user's right hand) may thus cause tension in the left side of the cable 130 to cause the directional shovel blade 125 to pivot about axis 126 to instead be in the pivotal position shown in FIG. 1B.

Figure 1C:
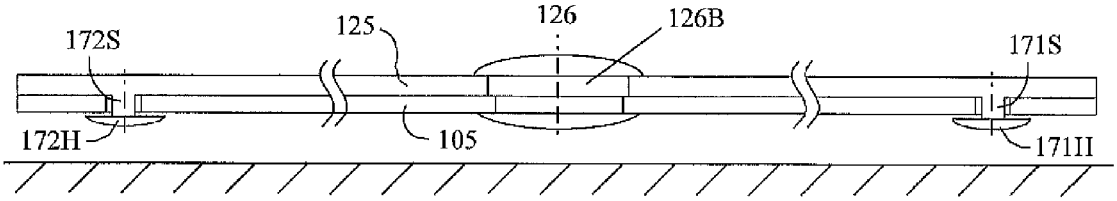
FIG. 1C is a cross-sectional view through the front edge of the base blade and the directional blade of FIG. 1A.
Figure 1F:
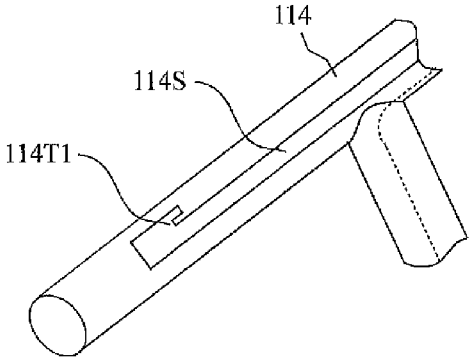
FIG. 1F is an enlarged detail view of the handle of the directional shovel of FIG. 1A.

To assist the user of the directional shovel 100 in moving the sliding member 140 between those two lateral positions, a lever 141 may extend from the sliding member, and may protrude out through a slotted opening 114S in the handle 114 (FIG. 1F). Furthermore, to releasably secure the sliding member 140 at either of those two positions, thus securing the directional shovel blade 125 at either of the two respective pivotal positions, the lever arm 141 may be configured to engage a respective tab 114T1, or a corresponding tab on the opposite side of the slotted opening 114S. To cause positive engagement of the lever arm 141 with each of the tabs (e.g., 114T1), the sliding member 140 may be biased to be at a central position with respect to the handle 114, using a spring 144 that is connected, using a cable 145 or other flexible member, to a central position of the sliding member. The spring 144 may be located in a hollow portion of the shaft 112.

To more easily accommodate movement of the cable 130 as the sliding member 140 slides between its two lateral positions, the cable may be guided proximate to the handle 114 using a first pulley 151 and a second pulley 152, respectively mounted at the ends of the handle. In addition mounting rings or pulleys 151A and 151B may be secured to the base shovel blade 105 to assist the cable 130 in proximity thereto, to assist with moving the directional shovel blade 125 into the pivotal position of FIG. 1B. Also, mounting rings or pulleys 152A and 152B may be secured to the base shovel blade 105 to assist the cable 130 in proximity thereto, to assist with moving the directional shovel blade 125 into the pivotal position of FIG. 1A. At least two of the mounting rings (or pulleys) may be selectively positioned to orient the cable to be roughly tangent to the respective rotate motion experienced by the cable attachment at the ends 130 and 131.

When the directional shovel 100 of FIG. 1A is used, for example, to shovel snow, as the shovel is pushed in a forward direction, the snow may be directed up the curved portion of the directional shovel blade 125, which may cause it to deform towards the user, particularly on the throwing side of the blade (i.e., at the corner formed by ends 123 and 122 for the pivotal position of FIG. 1A, and at the corner formed by ends 124 and 122 for the pivotal position of FIG. 1B). To counter this deformation, a support may be mounted to each side of the base shovel blade 105. A support 161 may be selectively mounted near end 103, and a support 162 may be selectively mounted near end 104. The mounting locations may be such that the support 162 would oppose deformation of the directional shovel blade for the pivotal position shown in FIG. 1B, and the support 161 would oppose deformation of the directional shovel blade for the pivotal position shown in FIG. 1A. There may normally be a slight clearance between the supports 161 and 162, and the directional blade 125, and thus contact may only occur as loads cause the directional blade to deform somewhat.

Alternatively, or additionally, to assure that the leading edge 121 of the directional shovel blade 125 maintains good and consistent contact with the base shovel base 105, when such loading of the upper part of the directional blade occurs, the ends of the directional blade being distal from the pivot axis 126 may be supported, as seen in FIG. 1C. Shafts 171S/172S may protrude down from each side of the directional shovel blade 125, and may terminate in a respective head 171H/172H. As seen in FIG. 1A, a first arcuate opening 105Ai and a second arcuate opening 105Aii may be formed in the flat portion of the base shovel blade 105, and may be formed to each have an axis substantially concentric with the axis 126 for the pivotal coupling at 126B. The shafts 171S/172S may be configured to respectively protrude through the two arcuate openings 105Ai and 105Aii. The respective heads 171H/172H may be positioned to provide a small amount of clearance with the bottom surface of the base shovel blade 105, as seen in FIG. 1C. Alternatively, the heads may be in slight contact with the bottom surface of the base shovel blade 105. The shafts 171S/172S may be welded to the directional shovel blade 125, or may be formed thereon using any suitable means, including, but not limited to, using a bucked rivet.

Figure 2A:
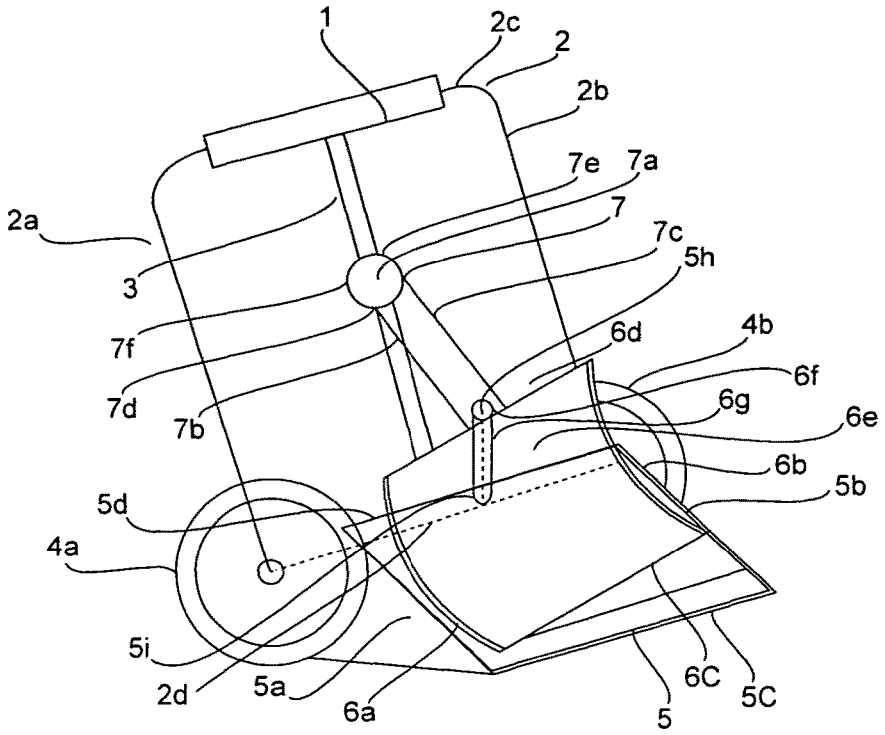
FIG. 2A shows a top perspective view of another embodiment of the directional shovel of the present invention.
Figure 2B:
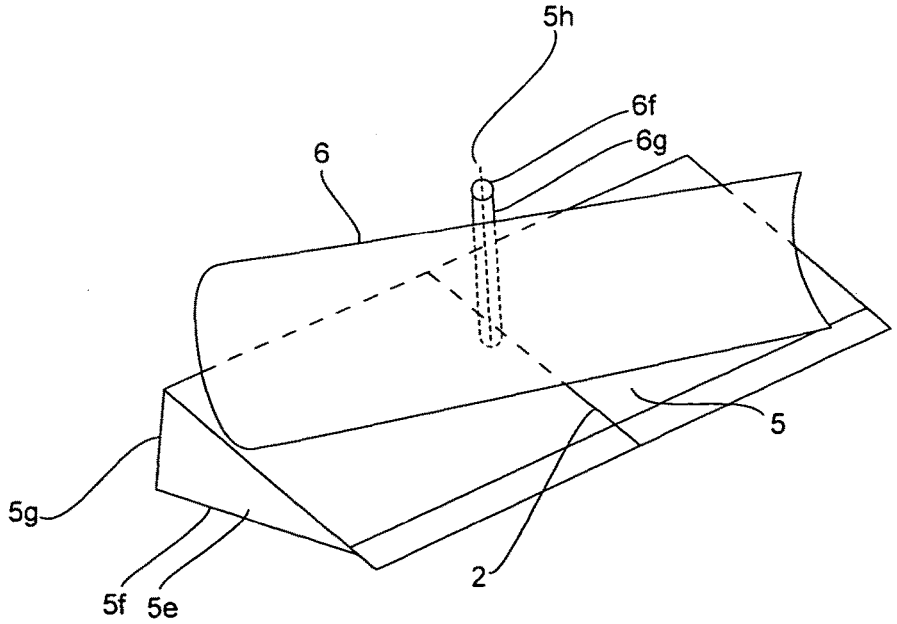
FIG. 2B shows a close up top view of the relation between the directional shovel blade and the base shovel blade. Further shown in FIG. 2B is a side view of a support member for the base shovel blade.
Figure 3:
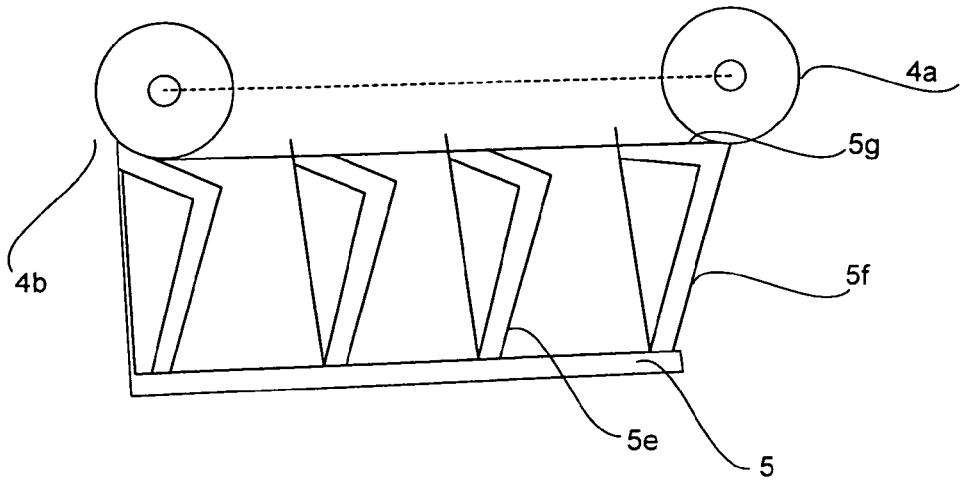
FIG. 3 shows the underside of the base shovel blade that includes the plurality of support members.

The directional shovel 100 may also include one or more additional support members fixedly secured to a bottom of the base shovel blade, each of which may have a wheel rotatably coupled thereto (see e.g., FIGS. 2-3). The additional support members may be equally spaced laterally between the first wheel 106 and said second wheel 107.

As seen in FIG. 1B, a first tube 191 and second tube 192 may extend from the ends of the handle 114, down to the base shovel blade 105, to enclose the cable 130 therein. Gusset plates 193 and 194 may connect the tubes to the shaft 112, for increased strength and rigidity. The tubes may be fixedly secured to the handle and to the base shovel blade.

A front perspective view of another embodiment of the directional shovel is shown in FIG. 2A and includes a horizontally situated handle 1 coupled to a frame 2 that has a first side member 2*a*, a second side member 2*b*, a top frame member 2*c*, and a bottom frame member 2*d*. The handle 1 connects to the frame 2 along a substantially central portion of the top frame member 2*d*. A shaft 3 extends perpendicularly from a substantially central point of the handle 1 to a substantially central point of the bottom frame member 2*d*. Wheels 4*a* and 4*b* may be secured on either end of the bottom frame member 2*d*. A base shovel blade 5 is secured to the bottom frame member 2*d* at a rear end 5*d* of the blade and extends to a front end 5*c* of the base blade 5. The base blade further includes a first side edge 5*a* and a second side edge 5*b* that extend between the front 5*c* and rear end's 5*d* first and second ends, respectively. The base shovel blade 5 is preferably a substantially planar member that extends at a downward angle from the bottom frame member 2*d* to the surface the base blade 5 contacts. At least a portion of the base shovel near the shovel's front end 5*c* is preferably made of a durable material to withstand the stress imposed thereon from the snow or other shoveled load, as well as the stress from the surface the shovel is moving along, such as asphalt or concrete. Further, the front end 5*c* may also have one or more miniature wheels to reduce the force required to move the shovel. Even further, at least a portion of the front end 5*c* may be hardened steel.

A directional shovel blade 6 is positioned atop the base shovel blade 5. The front surface 6*e* of the directional shovel blade 6 has a concave arcuate profile that includes a leading edge 6*c* and a first and second side edge 6*a* and 6*b* extending from the respective ends of the leading edge to a top edge 6*d*. The side edges are curved to contribute to concave blade profile 6*e* that is suitable for shoveling snow, dirt, other granulated material or other desired loads.

FIG. 2A also shows a rod-like member 5*h* that is preferably secured at a substantially central location 5*i* on the front surface near the base blade's rear end 5*d*. The rod-like member extends upward from the base blade 5 to an attachment at the back of the directional blade 6 by preferably using a membrane 6*f* attached to the rear middle of the adjustable blade 6 of which a tube 6*g* is affixed to. The rod-like member 5*h* and tube 6*g* together provide stationary support on the blade 5 on which the movable blade 6 can turn side to side in a sturdy fashion.

A steering mechanism 7 in communication with the directional shovel blade 6 is preferably located at about the midpoint of the longitudinal length of the shaft 3. The steering mechanism 7 preferably comprises a round steering plate 7*a* and at least a pair of laterally spaced apart cable- or rod-like members 7*b* and 7*c* that extend from opposite points 7*d* and 7*e* on the steering plate 7*a* to opposite central points on the top edge 6*d* of the directional shovel blade 6. In other embodiments, the cable-like members may be secured to opposite points on the top, rear or lower part of the directional shovel blade; or the cable like members may be secured to a gearbox mechanism (not shown) that may be located behind the directional blade but above the base blade 5.

The cable like members 7*b* and 7*c* may be secured to protrusions (not shown) on opposite sides of the steering plate 7*a* by, for example, a loop on the ends of the cable like members that may be received by the respective protrusions. A means for retaining the looped ends of the cable like members may be included on the protrusions. The means may include but are not limited to a flanged end on each protrusion to retain the looped end around the protrusion.

The steering plate 7*a* is preferably a circular member that is rotary and that is in communication with a handle 7*f* to facilitate turning of the plate 7*a*. To position the directional blade 6 in a first side or second side direction, a user may rotate the steering plate 7*a*. Upon rotation of the steering plate 7*a* the changing position of the cable like members 7*b* and 7*c* manipulates the directional blade to force the directional blade in a first side or second side position. Depending upon the direction of rotation of the plate 7*a*, one of the pair of cable-like members is rotated towards a higher position relative to its non-rotated position while the other cable-like member is rotated to a lower position relative to its non-rotated position.

As is seen in FIG. 2A, the cable-like member 7*b* that is rotated to a higher position pulls the directional blade 6 towards the steering plate's 7*a* direction of rotation. The other member 7*c* that is rotated to a lower position pushes the directional blade towards the direction of rotation of the steering plate 7*a*. Further, the steering plate is capable of locking into place via gears or pins to thereby lock the directional blade in a left or right positional facing direction.

FIG. 2B shows a top perspective view of the directional shovel blade that is positioned to direct a shoveled load to a side direction of the base blade. Further shown in FIG. 2B is a side view of a bottom support member Se that may be secured to the bottom side of the base shovel blade 5 to support the base shovel blade 5 and maintain the blade at an angle relative to the surface upon which the leading edge of the blade is resting. The bottom support may specifically include a floor support member 5*f* extending from the front end 5*c* of the base blade towards a point that is below the rear end 5*d* of the base blade 5. A vertical support member 5*g* may extend perpendicularly from the end of the floor support member that is below the base blade rear end point 5*d* to a corresponding point on the rear end of the base blade. The vertical support member 5*g* serves as the vertical support for the base blade and may include an adjustable height feature to adjust the height of the base blade. The floor support member and vertical support member may be secured to the bottom of the base shovel blade by screws, by being fused or welded or by other means used in the art.

A more complete view of an embodiment of the bottom surface of the direction blade is shown in FIG. 3. Here, there are four spaced apart bottom support members Se secured to the bottom surface of the base shovel blade but in other embodiments there may be no bottom support members or there may be more than four or less than four bottom support members, such as one, two, three or five support members. The bottom support members 5*e* in combination with the shovel frame's bottom frame member 2*d* secure the base shovel blade at an angle relative to the surface that the base blade's leading edge 5*c* is resting upon. The angular position of the directional shovel blade 6 allows snow being displaced by the pushing force of a user to travel up the front surface of the base blade to come into directional contact with the directional shovel blade 6 in order to be directionally displaced by the directional shovel blade. Further, the bottom adjustment members may have a height adjustment feature to adjust the height of the bottom support members' vertical member and therefore the height and angle of the shovel base blade.

Figure 4:
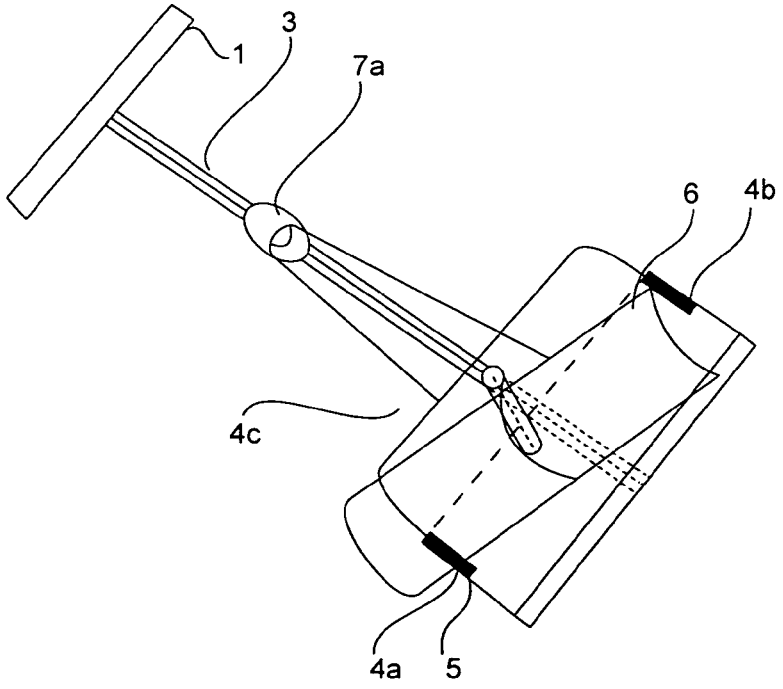
FIG. 4 shows a top view of a second embodiment of the directional shovel.

FIG. 4 shows a top view of an alternate embodiment of the directional shovel of FIG. 2A, wherein the directional blade is positioned in an opposite direction than shown in FIG. 2A. Here, the steering plate 7*a* has been rotated in an opposite direction than the rotation used for the positioning of the directional shovel blade 6 in FIG. 2A. The opposite rotation positions the directional blade in the opposite direction than in FIG. 2A. Further, there is no frame present in the FIG. 4 embodiment; rather, the horizontally situated handle 1 and the shaft 3 extending therefrom, and the directional blade steering mechanism 7 are the only support mechanisms for the base shovel blade 5 and the directional shovel blade 6. The embodiment of FIG. 4 shows wheels 4*a* and 4*b* that are secured at a first side and second side respectively of the shovel. The wheels 4*a* and 4*b* are connected to a lower wheel support bar 4*c* in this embodiment. The lower wheel support bar 4*c* is secured to and perpendicularly intersects a lower end of the shaft 3. The lower wheel support bar extends from the first side of the base blade to the second side of the base blade. At the first and second side of the base blade the lower wheel support bar curves downwards to secure to the respective wheels. In other embodiments of the invention there may or may not be wheels present. In the embodiment where there are no wheels present, the shaft 3 may be directly secured to the base blade 5 rather than being secured to the bottom frame member as in FIG. 2A.

Figure 5:
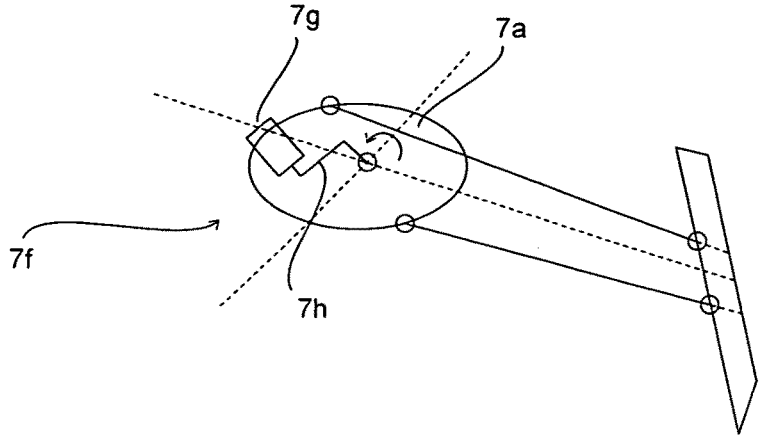
FIG. 5 shows a close up perspective view of an embodiment of the steering mechanism used to direct the directional shovel blade.

With reference now to FIG. 5, seen is a close up view of the steering plate in connection with a possible rotation mechanism for the steering plate. The handle 7*f* for the steering plate in FIG. 5 is in the form of a knob 7*g* that is connected to the steering plate by a wire 7*h*, rod or other material known in the art. In this embodiment the user may turn steering plate by applying a force to the knob 7*g*. Also shown in FIG. 5 is the distance between the horizontal axis passing through the central point of the steering plate and the top edge of the side of the directional shovel is less for the side of the top edge of the shovel that the directional blade is directed towards and greater for the side of the shovel that the directional blade is directed away from.

Figure 6:
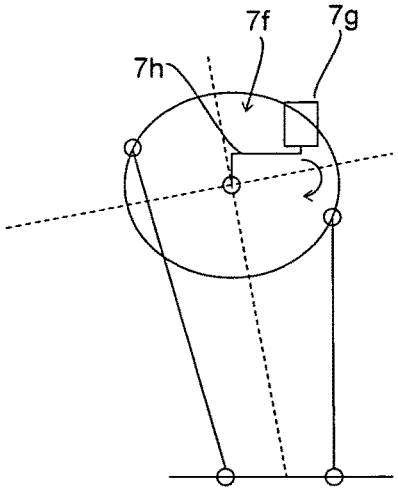
FIG. 6 is a further close up view and illustration of the steering mechanism used to direct the directional blade.

FIG. 6 shows a close up view of the steering plate and steering mechanism of the present invention that is rotated in the opposite direction than in FIG. 5.

Figure 7:
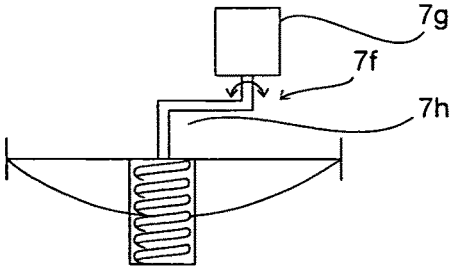
FIG. 7 shows a horizontal cross sectional view of a specific embodiment of the steering mechanism that includes a handle to rotate the steering plate and a screw to secure the steering plate in its rotational position.

A horizontal cross sectional view of the steering plate and handle shown in FIG. 5 is depicted in FIG. 7. This Figure shows that a screw may be used to maintain the position of the steering plate after it has been rotated to direct the directional shovel blade. Also, a rotating wheel and gear box mechanism may alternatively be used to maintain the position of the steering plate once the steering plate has been placed in the desired position. In an embodiment of the invention, the handle that is turned may be connected on the opposite end to a rotating wheel assembly (gear box) using ridged or rigid hard like screws and wheels that the operator turns using a lever or a rotating handle clockwise or counter clockwise. Tongue and groves connected at the base of the handle bar may then turn the rotating wheel that may permanently be attached to the underside of the directional blade while residing on the top side of the base blade. The gear box may not only enable the turning of the blade from facing one side to the other side, but it could also be holding in place the connection between the directional and base blades and therefore keep the plates at a fixed desired direction and position.

Figure 8:
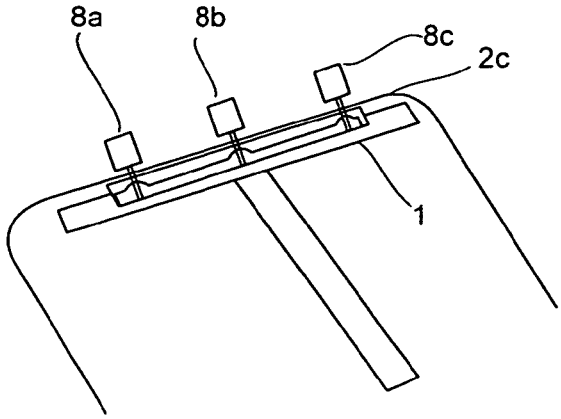
FIG. 8 is a perspective view of an alternate steering mechanism for directing the directional shovel blade of the present invention.
Figure 9:
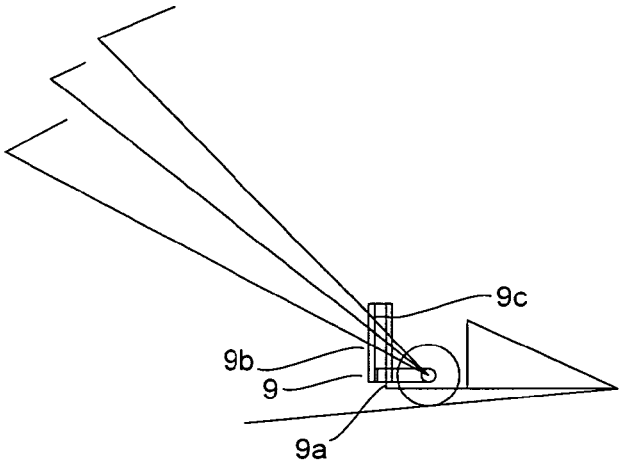
FIG. 9 is a side view of the mechanism for adjusting the height and angle of the shovel shaft/handle.

An alternate method for directing the directional shovel blade of the present invention is shown in FIG. 8. Here, the shovel may have a shaft 3 connected to a horizontally situated handle 1 as seen in FIGS. 1-7 and a frame 2 may also be coupled to the handle 1. However, in other embodiments of FIG. 8 and FIGS. 1-7, the shovel may only have a shaft and handle as depicted in FIG. 4 or a frame may only be present and not include the shaft and handle. Even further, only a frame and a shaft may be present and the shaft may extend from a central point on the top frame member to a central point on the bottom frame member or to a point on the base shovel blade.

The method for directing the directional shovel blade as seen in FIG. 8 includes a first side steering member 8*a*, a centrally located steering member 8*b*, and a second side steering member 8*c* in contact with the horizontally situated handle 1, or in contact with the top frame member 2*c* where there is no handle present. Each steering member is preferably in communication with at least one respective cable-like member. The respective cable-like members are also in communication with the directional shovel blade. In operation, a user may activate one of the steering members to direct the directional blade 6 in the position that corresponds to the steering member. For example, the activation of the first side steering member 8*a* corresponds to the front surface of the directional blade being angled to the first side of the shovel apparatus to displace a shoveled load towards that side. Further, the activation of the centrally located steering member 8*b* corresponds to the front surface of the directional blade facing forwards. Last, the activation of the second side steering member Sc corresponds to the front surface of the directional shovel blade being moved to face the second side of the shovel apparatus.

The steering members 8*a*-8*c* in FIG. 8 are shown as levers that may be pushed down to activate the respective steering member but other activation mechanisms known in the art are contemplated. The lever, when activated, may be locked into place by a gear locking mechanism or other locking mechanism used in the art. There may also be a feature where a steering member becomes automatically deactivated when another steering member becomes activated. Further, in an alternative embodiment, there may be one lever for adjusting the directional blade that may be slidable along the handle. The lever may be pulled back and retained in the pulled back position by a spring mechanism to retain the directional blade in a desired position. The retained positioned may then be deactivated by pushing the lever forward to remove the lever from the retained position. The lever may then be moved along the handle to a position that corresponds with the direction of the directional blade. There may be grooves or channels along the length of the handle that correspond to the different directional blade positions. The lever may be pulled into the groove or channel to retain the lever in that position.

The adjustment gear plate and knob, which may be held back towards the operator by a spring like device attached at the base of the gear plate and knob and below the surface of the plate, may pull the adjustment rod backwards. Once the adjustment rod is moved forward, it preferably disengages and allows the operator to move the rod from right to middle to left. The same pulling spring preferably pulls the rod backwards towards the operator and thereby forces it to fall and remain in its engaged position.

FIGS. 9-13 show angular adjustment mechanisms for the base shovel blade and the shovel shaft and/or frame. The angular adjustment 9 for the shovel shaft or frame is a different adjustment than the angular adjustment 10 for the base shovel blade. The shaft or frame adjustment may extend from one or both wheel axles and be in communication with the shaft and/or one or both of the side members of the shovel frame. For example, the shaft or frame adjustment 9 may include a base member 9*a* that extends perpendicularly rearward from an axle on the wheel to a vertical adjustment member 9*b* that extends perpendicularly upward from the end of the base member 9*a* that is distal to the wheel axle.

The vertical adjustment member may include an open vertical slot 9*c* on one side of the member that may receive a pin (not shown) for extending through an orifice of one of a plurality of orifices that may be located on a lower portion of the shaft and/or frame member. The pin may have a threaded end that extends through the slot and may be received by one of a plurality of support members (not shown) on the vertical adjustment member that are directly opposite the vertical slot. The support members may be one of a plurality of orifices on the vertical adjustment member 9*b* that are located directly opposite the vertical slot. The orifices may be threaded and receive the threaded end of the pin. The pin is designed such that a portion of the threaded end of the pin that extends through the support member orifice may then extend through an orifice on the shaft or frame member to retain the pin and, in turn, the shaft or frame desired angular position. The orifice in the shaft and/or frame member may be threaded to receive the threaded end of the pin and/or a knob may be adapted to threadably engage the threaded end of the pin that extends through and past the shaft and/or frame orifice.

Further, there may be a plurality of support members to allow a plurality of angular adjustments of the shaft and/or frame. The orifices may be threaded and receive a threaded end of the pin to maintain the shaft and/or frame in its adjusted position. A knob may be secured to the end of the pin that is opposite the pin's threaded end. The knob helps a user to easily handle and manipulate the pin. Further, other adjustment mechanisms known in the art may also be used in the present invention.

The shovel blade adjustment 10 may include the same specific adjustment mechanism as the shaft and/or frame adjustment mechanism; however, the structure of the blade adjustment may only include one member 10*a* that resides along a portion of the top of at least one of the wheels of the shovel apparatus. This member may include an open slot 10*b* on at least one side of the member that may receive at least one pin that may include a knob at one end. The open slot may have one or more traversing members that also have open slots (not shown). The pin may be inserted through the open slot 10*b*, then through an open slot in the traversing member, and be received by a receiving means on a side edge of the base blade to maintain the base blade in the position that corresponds to the traversed open slot. The receiving means on the base blade may include a threaded orifice in one or more locations on the base blade's side edge that may be received by a threaded end of the pin that is distal to the knobbed pin end. The receiving means may alternately include an extension from the base blade that includes a threadable opening to receive the threaded end of the pin. The side edge of the base blade that comes into contact with the blade adjustment mechanism may have the receiving means located at various points along the base blade's side edge to allow for a variety of blade positions. The shaft and/or frame adjustment mechanism may also have traversing members and a receiving means that includes an extension from the shaft and/or frame with a threadable opening.

Figure 10:
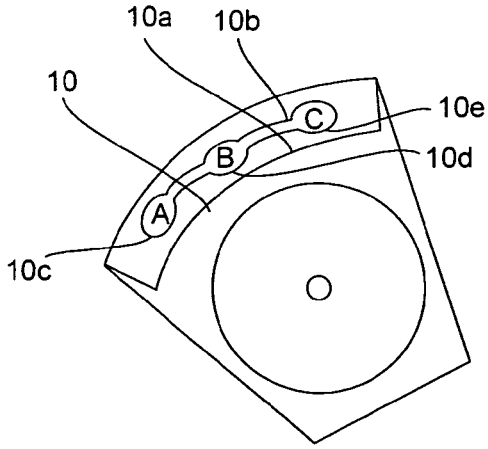
FIG. 10 is a side view of the mechanism for adjusting the height and angle of the base shovel blade.
Figure 11:
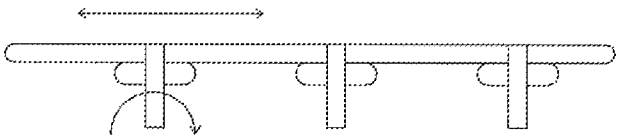
FIG. 11 is an illustration of the mechanism for adjusting base shovel blade.
Figure 12:
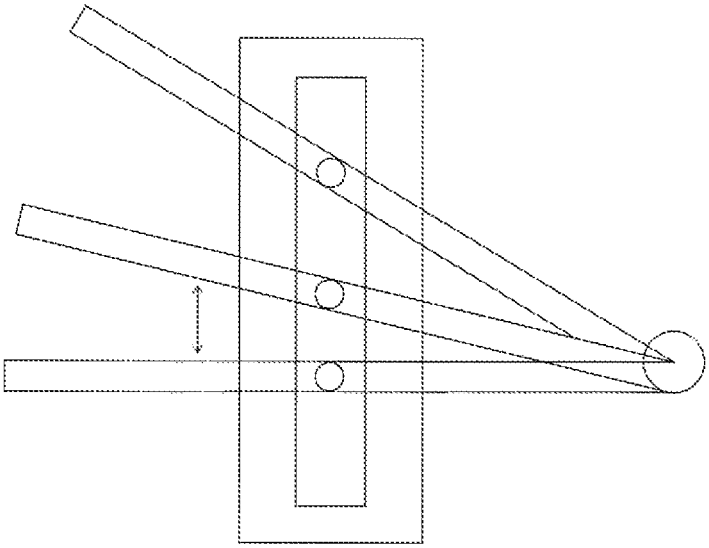
FIG. 12 is a view of the adjustment mechanism for the shovel shaft/handle.
Figure 13:
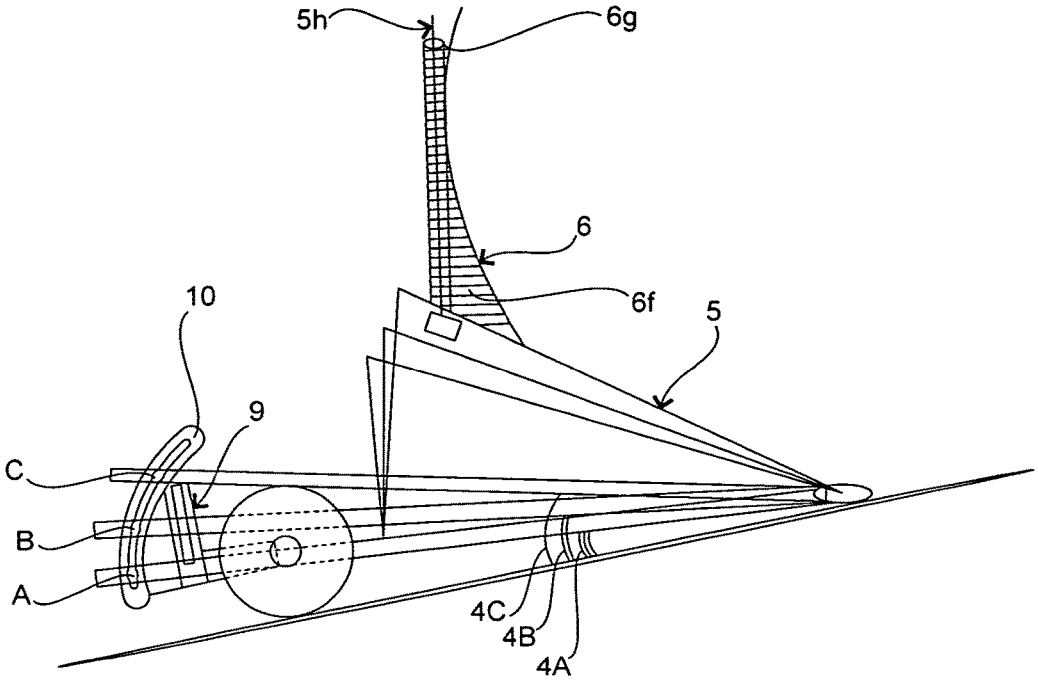
FIG. 13 represents a side view of the angular difference between adjustable positions of the base shovel blade.

The open slot 10*b* in the sidewall of the blade adjustment member 10*a* shown in FIG. 10 includes three enlarged points 10*e*, 10*d*, and 10*e* that correspond to three blade adjustment positions. The pin may be inserted at any of these enlarged points to secure the blade in the adjustment that corresponds to the point.

Figure 14:
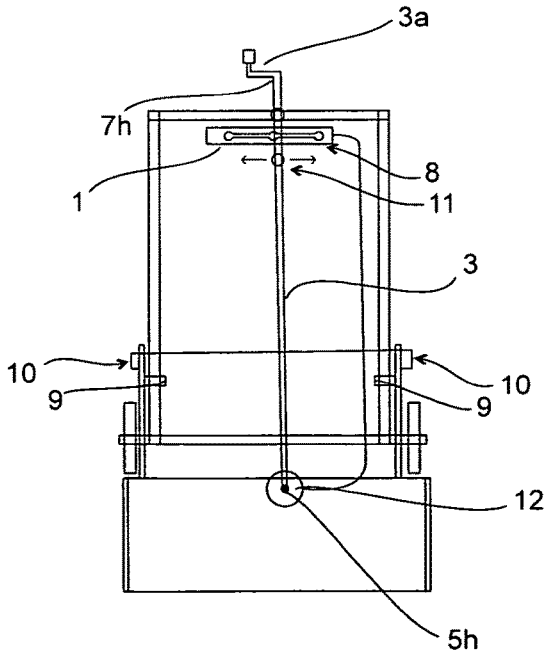
FIG. 14 shows a top view of a further alternate embodiment of the directional shovel of the present invention.
Figure 15:
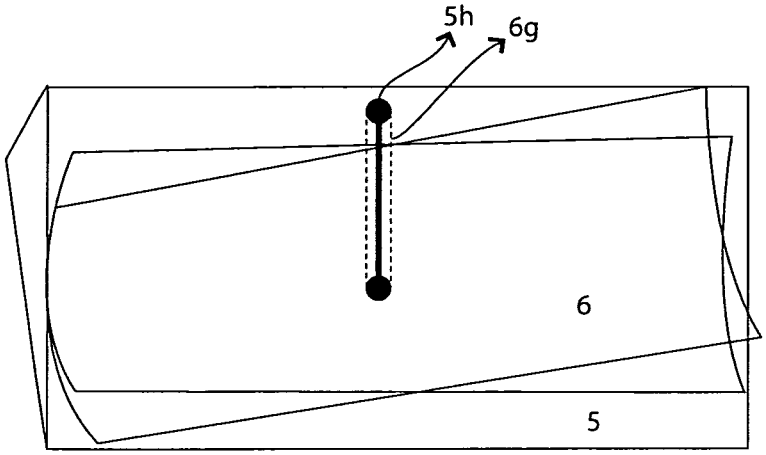
FIG. 15 shows a top relational view of the directional and base shovel blades as well as the support structure between the two blades.

FIG. 14 shows a top view of an embodiment of the directional shovel that includes two shaft and/or frame adjustments 9 and two shovel blade adjustments 10 each located near the wheels 4*a* and 4*b* on the first and second side, respectively. In this embodiment, a T-bar configuration or a U-bar configuration may be used. Where a T-bar configuration is used, the steering mechanism 8 may be as that which was disclosed in FIG. 8 such that the steering members are located on the handle 1. Where a U-bar configuration is used, the steering mechanism 11 may be located along an upper portion of the vertical shaft 3 in vertical alignment. The vertically situated steering mechanism 11 may include the same workings as the steering mechanism described in FIG. 8. Further, a steering handle 3*a* may be located at the top of the shaft in the embodiment using the vertical steering mechanism. Where a T and U-bar configuration is used, three points of support may be achieved by using the middle bar as the lever adjusting mechanism.

In the embodiment of FIG. 14, a mechanism for controlling the position and direction of the directional blade may be positioned in a location on top of the base blade and behind the directional blade. This mechanism may be a gear box 12.

The material used in the present invention may be light weight such as but not limited to aluminum, a rigid plastic, a resin, a composite thereof and any other materials known to provide durability and performance and that are light weight to allow for less stressful use of the shovel.

In a further embodiment of the invention, the directional shovel may be connected to motorized equipment that will be able to push the shovel by motorized propulsion rather than by the force of the operator. In this embodiment, the directional shovel still allows the shovel to move in a fairly straight path while being able to push the shoveled material towards a side of the shovel directional path. In even further embodiments of the motorized equipment, one or more wheels easing movement may or may not be necessary. Also different heights of the blade of the shovel can be envisioned for different usages and also for the different materials being moved. Materials that may be used to construct the directional shovel in this or the other embodiments of the invention may be a hard resin, plastic, steel, a composite thereof or other materials used in the art. Further, the materials for the wheel or other directional control attached to the shovel and blade is preferably made of a mechanism and material not to fail under strenuous weight and pressure and is made according to the present application which is intended to ensure durability and prevent fatigue and failure of this part of the equipment.

The invention claimed is:

1. A directional shovel comprising:

a base shovel blade having at least a leading edge, a first side and a second side;

a shaft, a portion proximate to a first end of said shaft fixedly secured to said base shovel blade;

a handle fixedly secured to a second end of said shaft;

an upper shovel blade, said upper shovel blade comprising a flat portion and an arcuate portion tangent to said flat portion; said flat portion of said upper shovel blade being pivotally coupled to said base shovel blade;

means for controlling a pivotal position of said upper shovel blade to occupy at least a first pivot position and a second pivot position;

wherein at least a portion of said base shovel blade is substantially flat; and wherein said flat portion of said upper shovel blade is pivotally coupled to said base shovel blade in proximity to said leading edge.

2. The directional shovel according to claim 1 further comprising an axle secured to said base shovel blade, and a first wheel rotatably coupled to a first end of said axle and a second wheel rotatably coupled to a second end of said axle.

3. The directional shovel according to claim 2 further comprising one or more support members fixedly secured to a bottom of said base shovel blade.

4. The directional shovel according to claim 3 further comprising a wheel rotatably coupled to a bottom of each said support member.

5. The directional shovel according to claim 4 wherein said one or more support members are equally spaced laterally between said first wheel and said second wheel.

6. The directional shovel according to claim 1 further comprising a first arcuate opening and a second arcuate opening respectively positioned on opposites sides of said base shovel blade, to have a substantially concentric axis; and a first rivet and a second rivet each having a shaft protruding down from a bottom surface of said substantially flat portion of said upper shovel blade, each said shaft of said first and second rivets configured to be moveable within a respective said arcuate opening, and to be captive therein by a head on each said rivet disposed on a bottom side of said base shovel blade.

7. The directional shovel according to claim 1 further comprising at least one wheel configured to support said base blade.

* * * * *